United States Patent [19]

Sooch

[11] Patent Number: 4,583,037

[45] Date of Patent: Apr. 15, 1986

[54] HIGH SWING CMOS CASCODE CURRENT MIRROR

[75] Inventor: Navdeep S. Sooch, Reading, Pa.

[73] Assignee: AT&T Bell Laboratories, Murray Hill, N.J.

[21] Appl. No.: 643,636

[22] Filed: Aug. 23, 1984

[51] Int. Cl.[4] ..... G05F 3/26

[52] U.S. Cl. ..... 323/315; 330/277; 330/288

[58] Field of Search ..... 323/315, 316, 317; 330/277, 288

[56] References Cited

U.S. PATENT DOCUMENTS

| | | | |
|---|---|---|---|
| 3,852,679 | 12/1974 | Schade, Jr. | 330/257 |
| 3,887,879 | 6/1975 | Radovsky | 330/257 |
| 3,953,807 | 4/1976 | Schade, Jr. | 330/277 |
| 4,247,824 | 1/1981 | Hillbourne | 330/253 |
| 4,281,261 | 7/1981 | Adam | 307/270 |
| 4,297,646 | 10/1981 | LoCascio et al. | 330/288 |
| 4,327,321 | 4/1982 | Suzuki et al. | 323/315 |
| 4,412,186 | 10/1983 | Nagano | 330/288 |
| 4,450,366 | 5/1984 | Malhi et al. | 307/297 |
| 4,461,991 | 7/1984 | Smith | 323/315 |
| 4,471,292 | 9/1984 | Schenck | 330/288 |

FOREIGN PATENT DOCUMENTS

| | | | |
|---|---|---|---|
| 68946 | 6/1977 | Japan | 323/315 |

*Primary Examiner*—William H. Beha, Jr.
*Attorney, Agent, or Firm*—Wendy W. Koba

[57] ABSTRACT

A CMOS cascode current mirror exhibits an input side voltage swing equal to $V_T+2V_{ON}$ and provides virtually no mismatch between the input and output currents. A negative feedback loop (52) comprising a plurality of MOS transistors is utilized to provide the voltages necessary for good current matching ($V_T+2V_{ON}$, $V_T+V_{ON}$) and to maintain the transistors of the input circuit branch in their saturation region of operation. By maintaining the input transistors in saturation, the output current will track the input current, regardless of increases in ambient temperature or the value of threshold voltage $V_T$.

4 Claims, 3 Drawing Figures

HIGH SWING CMOS CASCODE CURRENT MIRROR

BACKGROUND OF THE INVENTION

1. Field of the Invention

The present invention relates to a CMOS current mirror and, more particularly, to a CMOS cascode current mirror which provides a high input voltage swing.

2. Description of the Prior Art

Current mirror circuits are well known in the art and have found uses in a variety of applications. Generally speaking, a current mirror circuit comprises a pair of transistors where an input reference current source is connected to drive one of the transistors. The pair of transistors are connected together in a manner whereby the reference current is substantially reproduced, or mirrored, at the output of the second transistor. In most cases, the critical factor in designing a current mirror circuit is providing optimum matching between the reference and output currents. U.S. Pat. No. 4,297,646 issued to LoCascio et al on Oct. 27, 1981 relates to a current mirror circuit, comprising bipolar transistors, with improved current matching provided by utilizing a single, split collector lateral bipolar transistor.

Current mirrors can also be formed using MOS devices, where one such arrangement is disclosed in U.S. Pat. No. 4,327,321 issued to H. Suzuki et al on Apr. 27, 1982. The Suziki et al circuit also includes a resistor in the input rail between a P-channel MOSFET and an N-channel MOSFET to minimize the output current dependency on variations in the power supply. In MOS technology, small channel length devices are increasingly in demand. In relation to current mirror circuits, the decrease in channel length results in the decrease of the output impedance of the current mirror. Cascoding techniques become necessary, therefore, to increase the output impedance.

One exemplary MOS circuit arrangement which utilizes cascoding is disclosed in U.S. Pat. No. 4,247,824 issued to R. A. Hilbourne on Jan. 27, 1981. Here, a high output impedance is maintained by utilizing a compensating voltage produced by the connection of an enhancement mode transistor in cascode with a depletion mode transistor.

These and other prior art cascode current mirror arrangements have not been widely used since they often exhibit one or more of the following problems; inadequate input side voltage swing, unreliable operation with worst-case processing and temperature, excessive amounts of offset between the input and output currents.

SUMMARY OF THE INVENTION

The problems associated with prior art current mirrors are addressed by the present invention which relates to a CMOS current mirror and, more particularly, to a CMOS cascode current mirror which provides a high input voltage swing.

It is an aspect of the present invention to provide a CMOS current mirror which exhibits an input voltage swing equal to $V_T+2V_{ON}$.

Another aspect of the present invention is to provide accurate matching between $I_{REF}$ and $I_{OUT}$ over a wide range of processing and temperature variations.

Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
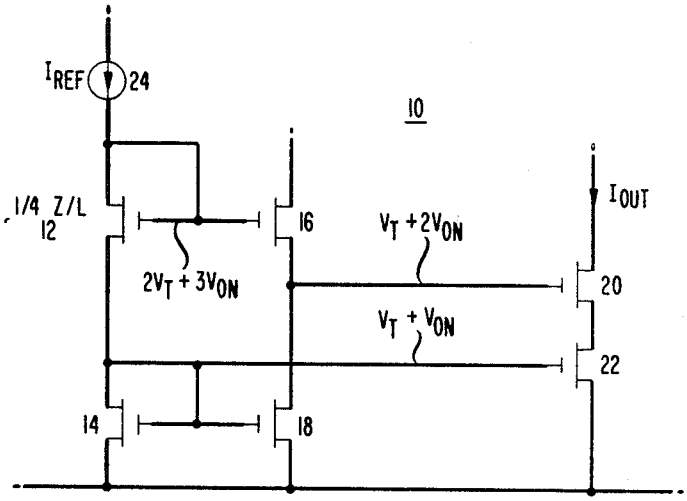
FIG. 1 (PRIOR ART)
FIG. 1 illustrates a prior art CMOS cascode current mirror, referred to in the art as the Gray-Meyer cascode.

A conventional prior art cascode current mirror 10, formed with MOS devices and referred to as the Gray-Meyer cascode, is illustrated in FIG. 1. As shown, a pair of MOS transistors 12 and 14 form the input circuit branch and are connected in series, where the gate of transistor 12 is connected to the drain of transistor 12 and similarly, the gate of transistor 14 is connected to the drain of transistor 14. The next circuit branch contains a serially connected pair of MOS transistors 16 and 18, where as shown in FIG. 1, the gate of transistor 16 is connected to the gate of transistor 12 and the gate of transistor 18 is connected to the gate of transistor 14. The remaining circuit branch, the output circuit branch, includes a pair of MOS transistors 20 and 22 also connected in series. In particular, the gate of transistor 20 is connected to the source of transistor 16 and the gate of transistor 22 is connected to the gates of transistors 14 and 18. A reference current 24, denoted $I_{REF}$, is applied to the drain of transistor 12 and is subsequently reproduced, or mirrored, at the drain of transistor 20. In order to provide a high output impedance, transistor 22 is biased on the edge of saturation, with its drain one threshold voltage, denoted $V_T$, more negative than its gate voltage, denoted $V_T+V_{ON}$, where $V_{ON}$ is defined as the turn-on voltage of the device. This biasing is provided by transistors 16 and 18, which generate the voltage $V_T+2V_{ON}$ at the gate of transistor 20. Transistor 12 is designed to comprise a channel width-to-length ratio (Z/L) one-fourth of the value associated with the remaining transistors to compensate for the addition of transistors 16 and 18. A disadvantage of the Gray-Meyer arrangement, however, is that the input side voltage requirement of $2V_T+3V_{ON}$ is too high for many applications. Additionally, a significant offset between $I_{OUT}$ and $I_{REF}$ will exist, on the order of $g_oV_T$ (where $g_o$ is defined as the transistor output transconductance), since the drain-to-source voltages of transistors 14 and 22 are inherently different.

Figure 2:
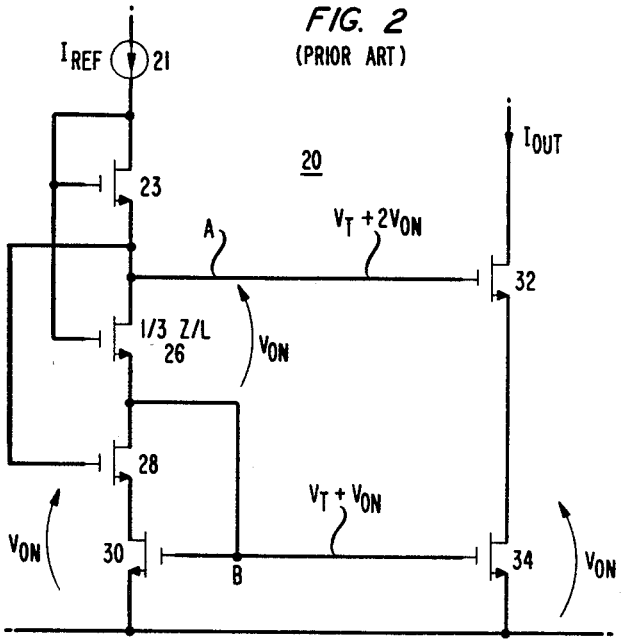
FIG. 2 (PRIOR ART)
FIG. 2 illustrates an alternative prior art CMOS cascode current mirror which provides a high output impedance.

An alternative prior art arrangement which provides both a greater degree of matching and lower power consumption than the Gray-Meyer circuit is illustrated in FIG. 2. Referred to as a high output impedance CMOS cascode current mirror, this circuit is described in detail in a co-pending application Ser. No. 610,881 filed on May 16, 1984, and assigned to the same assignee as the present application. As shown in FIG. 2, the input circuit branch comprises a plurality of serially connected MOS transistors 23, 26, 28, and 30, and an input reference current 21, referred to as $I_{REF}$. Transistor 26 is designed to be one-third the size of the remaining transistors in order to provide the necessary voltages at nodes A and B. The output circuit branch comprises a pair of MOS transistors 32 and 34 connected to the input branch as shown. Since transistors 30 and 34 will exhibit the identical drain-to-source ($V_{DS}$) and gate-to-source ($V_{GS}$) voltages, the currents flowing through each will be identical. Therefore, since reference current 21 flows through transistor 30 and the output current flows through transistor 34, $I_{OUT}$ will equal $I_{REF}$. However, a few problems do exist with this arrangement. In particular, the input side voltage of $2V_T+3_{ON}$ is too high for many applications. Further, at high temperatures and for small values of $V_T$, transistor 28 will fall out of saturation and enter its resistive region. Accordingly, transistors 30 and 34 will exhibit differing operating characteristics, creating a mismatch between $I_{REF}$ and $I_{OUT}$, referred to as a current offset.

Figure 3:
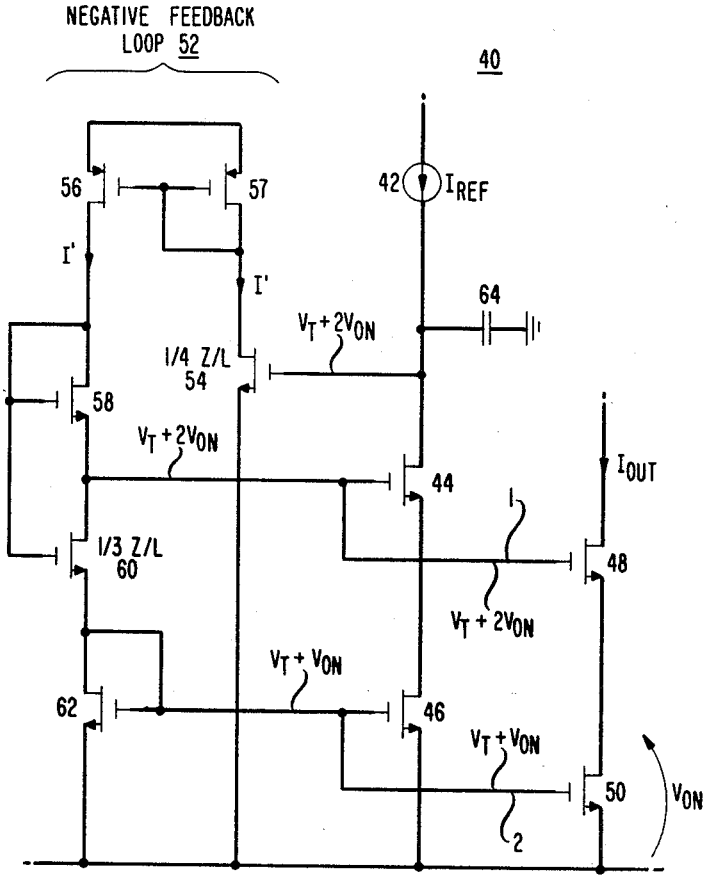
FIG. 3 illustrates a high swing CMOS cascode current mirror formed in accordance with the present invention.

The present invention provides a solution to the above-described problems, where a CMOS cascode current mirror 40 formed in accordance with the present invention is illustrated in FIG. 3. As will be described in detail hereinafter, the input voltage is maintained at the value of $V_T+2_{ON}$, which is significantly lower than the input voltage associated with the above-described prior art arrangements. Further, a negative feedback loop 52 is included in current mirror 40 to compensate for changes in both circuit temperature and process-determined values of $V_T$ so that the input and output transistors remain matched under any set of operating conditions. The arrangement shown, similar to the previous prior art circuits, includes N-channel MOS devices. However, it is to be understood that a current mirror formed in accordance with the present invention could also be formed from P-channel devices and the choice of N-channel devices in this instance is solely for the purpose of illustrating an exemplary embodiment of the invention.

Referring now to FIG. 3, the interconnection of the transistors forming current mirror 40 will be described. As shown, the input circuit branch of current mirror 40 comprises an input reference current 42, denoted $I_{REF}$, and a pair of MOS transistors 44 and 46, where the drain of transistor 44 is connected to reference 42 and the source of transistor 44 is connected to the drain of transistor 46. The output circuit branch comprises a pair of MOS transistors 48 and 50, where the source of transistor 48 is connected to the drain of transistor 50. The gate of transistor 48, as shown in FIG. 3, is connected to the gate of transistor 44 and in a similar manner, the gate of transistor 50 is connected to the gate of transistor 46. As will be described in detail hereinafter, current mirror 40 is designed to provide a voltage of $V_T+2V_{ON}$ at the gate interconnection of transistors 44 and 48, referred to as node 1, and a voltage of $V_T+V_{ON}$ at the gate interconnection of transistors 50 and 46, referred to as node 2. In accordance with the present invention, transistors 46 and 50 will exhibit the identical gate-to-source ($V_{GS}$) and drain-to-source ($V_{DS}$) voltages. Therefore, the current through each transistor will also be identical. Accordingly, since reference current $I_{REF}$ flows through transistor 46 and output current $I_{OUT}$ flows through transistor 50, $I_{OUT}$ will be equal to $I_{REF}$.

As stated above, an advantage of the present current mirror arrangement is that the output current will be unaffected by dramatic increases in ambient temperature or low process-determined values of $V_T$. These advantages are derived from the presence of negative feedback loop 52, where negative feedback loop 52 also provides the voltages necessary at nodes 1 and 2. Referring to FIG. 3, an MOS transistor 54 is included in negative feedback loop 52 to "sense" input current $I_{REF}$ and provide the current necessary to generate the voltages $V_T+2V_{ON}$ and $V_T+V_{ON}$ at nodes 1 and 2, respectively. Negative feedback loop 52 further comprises a simple wideband current mirror formed by MOS transistors 56 and 57. In particular, transistors 56 and 57 are P-channel devices arranged such that the gates of transistors 56 and 57 are coupled together and connected to the drain of transistor 54, the drain of transistor 57 also being connected to the drain of transistor 54, and the sources of transistors 56 and 57 are connected together. Therefore, in accordance with this current mirroring arrangement, the same current, denoted I', will flow through transistors 56 and 57 in the manner illustrated in FIG. 3.

In order to provide the voltages necessary for the operation of current mirror 40, the output of transistor 56 is applied as an input to a series connection of MOS transistors 58, 60, and 62. As shown in FIG. 3, the drain of transistor 56 is connected to both the drain and gate inputs of transistor 58, where the gate of transistor 58 is also connected to the gate of transistor 60. The source of transistor 58 is connected to the drain of transistor 60 and the source of transistor 60 is in turn connected to both the drain and gate of transistor 62. As shown in FIG. 3, the interconnection of the source of transistor 58 and the drain of transistor 60 is also connected to the gate interconnection of transistors 44 and 48, previously described as node 1. Therefore, the voltage at node 1 must be equal to $V_T+2V_{ON}$ to insure proper operation of current mirror 40. Similarly, the interconnection of the source of transistor 60 and the gate of transistor 62 is also connected to the gate interconnection of transistors 46 and 50, previously referred to as node 2. Therefore, the voltage at node 2 must be equal to $V_T+V_{ON}$ to insure proper operation of current mirror 40.

The starting point of a description of the generation of the voltages necessary for nodes 1 and 2 is transistor 62 and in particular, the gate to source voltage, $V_{GS}$, of transistor 62. It is well known that for this particular arrangement, the $V_{GS}$ of transistor 62 will be equal to $V_T+V_{ON}$. Therefore, the voltage at node 2 will be equal to $V_T+V_{ON}$, the value necessary for accurate current mirroring. With respect to the generation of $V_T+2V_{ON}$, transistor 60 is chosen to have a channel constant (Z/L) one-third that of transistor 62, where the value $\frac{1}{3}$ is illustrated in FIG. 3 in association with transistor 60. As explained in detail in copending application Ser. No. 610,881, the utilization of a transistor with a channel constant $\frac{1}{3}$ the size of the remaining transistors will cause transistor 60 to remain in its resistive region, thus providing a $V_{ON}$ voltage drop between its drain and source electrodes. In association with this $V_{ON}$ voltage drop, therefore, the voltage at node 1 will be equal to $V_T+2V_{ON}$, precisely the voltage necessary to insure proper operation of the present invention.

An important aspect of the present invention is the fact that current mirror 40 is relatively insensitive to large increases in ambient temperature or process-determined small values of $V_T$. This insensitivity is achieved by insuring that transistor 44 remains in saturation, regardless of changes in process or temperature. In accordance with the present invention, transistor 44 is maintained in saturation by providing a gate to drain voltage, $V_{GD}$, equal to zero. In other words, the voltage appearing at the drain of transistor 44 is maintained at the same level as the voltage at the gate of transistor 44. As shown in FIG. 3, the drain of transistor 44 is connected to the gate of transistor 54, which as explained above, is utilized to "sense" the input current $I_{REF}$. Assuming that the current I' flowing out of the current mirror formed by transistors 56 and 58 is approximately equal to $I_{REF}$, a voltage $V_T+2V_{ON}$ can be maintained at the gate of transistor 54 by sizing transistor 54 to have a channel constant one-fourth that of the remaining transistors. FIG. 3 illustrates the value ¼ in association with transistor 54. Therefore, the negative feedback from loop 52 is in the form of the gate voltage applied to transistor 44 and 46. Any change in the voltage at node 1 will result in a change in the opposite direction at the gate of transistor 54, thus continuously providing a zero voltage drop between the drain and gate of transistor 44. Since transistor 44 will always remain in saturation, virtually no current offset will exist between the input and output circuit branches.

In order to insure that the loop gain of feedback loop 52 remains less than one after the phase crosses 180 degrees, a capacitor 64 is included in the input circuit branch. If capacitor 64 was not present, a 180 degree phase reversal could occur in negative feedback loop 52 while the loop gain is greater than unity. This phase reversal would cause current mirror 40 to go into oscillation. The action of capacitor 64 thus provides a dominant pole which gives a sufficient phase margin (at least 45 degrees) so that the second pole occurs after the loop gain crosses zero.

It is to be noted that the transistors forming negative feedback loop 52 may all be scaled down in size with respect to the transistors forming the input and output circuit branches, provided transistors 60 and 54 maintain their one-third and one-fourth size scalings, respectively.

What is claimed is:

1. An MOS current mirror including an input circuit and an output circuit branch, where the input circuit branch is responsive to a reference current and the output circuit branch mirrors the reference current to produce an output current substantially equal to said reference current, said current mirror further comprising a negative feedback loop (52) responsive to said reference current for generating a first reference voltage ($V_T+2V_{ON}$) and a second reference voltage ($V_T+V_{ON}$) such that the difference between said first and second reference voltages is equal to the turn-on voltage of an MOS transistor ($V_{ON}$), said first and second reference voltages applied to said input and output circuit branches such that one MOS transistor included in each circuit branch exhibits identical gate to source ($V_{GS}$) and drain to source ($V_{DS}$) voltages for producing an output current that substantially mirrors said reference current, said negative feedback loop responsive to said reference current in a manner such that each MOS transistor in said input circuit branch remains in saturation.

2. An MOS current mirror as defined in claim 1 wherein the input circuit branch comprises a series connection of a first (44) and a second (46) MOS transistor, each MOS transistor having a gate, a source, and a drain electrode, where the drain of said first MOS transistor is coupled to the reference current and the source of said first MOS transistor is connected to the drain of the second MOS transistor, the gate of said first MOS transistor responsive to the first reference voltage generated by the negative feedback loop and the gate of said second MOS transistor responsive to the second reference voltage generated by said negative feedback loop; and the output circuit branch comprises a series connection of a first (48) and a second (50) MOS transistor, each MOS transistor having a gate, a source, and a drain electrode, where the source of said first transistor is connected to the drain of said second transistor, the gate of said first transistor is connected to the gate of the input circuit branch first transistor, and the gate of said second transistor is connected to the gate of the input circuit branch second transistor wherein the second transistor of both the input and output circuit branches exhibits the same gate-to-source voltage ($V_T+V_{ON}$) and the same drain-to source voltage ($V_{ON}$) such that an output current flowing through said output circuit branch will be substantially identical to the reference current flowing through said input circuit branch.

3. An MOS current mirror as defined in claim 2 wherein the negative feedback loop comprises a plurality of MOS transistors, each transistor having a gate, a source, and a drain electrode and comprising a channel constant defined by its associated channel width divided by its associated channel length, said plurality of MOS transistors including a first transistor (54) for sensing the reference current, the gate of said first transistor being coupled to the output of the reference current, wherein the associated channel constant of said first transistor is one-fourth the value of other selected transistors of said plurality of MOS transistors such that the gate-to-source voltage of said first transistor is equal to the first reference voltage generated by said negative feedback loop;

current mirroring means comprising a second (57) and a third (56) MOS transistor where the drain of said second transistor is connected to the drain of the first transistor, the source of said second transistor is connected to the source of said third transistor, and the gate of said second transistor is connected to both the gate of said third transistor and the drain of said first transistor, said current mirroring means capable of providing as an output a current (I') substantially equal to said reference current; and a series connection of a fourth (58), fifth (60), and sixth (62) MOS transistor for generating the first and second reference voltage outputs of said negative feedback loop, the channel constant of said fifth transistor being at most one-third the value of the channel constant associated with said fourth and sixth transistors to provide a voltage drop equal to $V_{ON}$ between the drain and source of said fifth transistor, wherein the drain of said fourth transistor connected to the drain of said third transistor and responsive to the current produced by said current mirroring means, the gate of said fourth transistor connected to both the drain of said fourth transistor and the gate of said fifth transistor, the source of said fourth transistor connected to both the drain of said fifth transistor and the gates of the first transistors (44,48) of both the input and the output circuit branches, said interconnection of the source of said fourth transistor and the drain of said fifth transistor capable of providing the first reference voltage output of said negative feedback loop, the source of said fifth transistor connected to both the drain and the gate of said sixth transistor, where the interconnection of said fifth and sixth transistors is connected to the gates of the second transistors (46,50) of both said input and said output circuit branches and provides the second reference voltage output of said negative feedback loop.

4. An MOS current mirror as defined in claim 1 wherein said current mirror further comprises a compensating capacitor (64) connected between the output of the reference current and ground for maintaining the loop gain associated with the negative feedback loop to a value less than unity when the phase exceeds 180 degrees.

* * * * *